US008371830B2

(12) United States Patent
Winkler et al.

(10) Patent No.: US 8,371,830 B2
(45) Date of Patent: Feb. 12, 2013

(54) FAN ARRANGEMENT

(75) Inventors: Wolfgang Arno Winkler, St. Georgen (DE); Jochen Wernet, Bräuningen-Stöckingen (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 807 days.

(21) Appl. No.: 12/424,554

(22) Filed: Apr. 16, 2009

(65) Prior Publication Data

US 2009/0263242 A1 Oct. 22, 2009

(30) Foreign Application Priority Data

Apr. 21, 2008 (DE) ..... 20 2008 005 917 U

(51) Int. Cl.
*F04D 29/60* (2006.01)

(52) U.S. Cl. ..... 417/423.1

(58) Field of Classification Search ..... 417/423.1, 417/410.1

See application file for complete search history.

(56) References Cited

U.S. PATENT DOCUMENTS

| | | | | |
|---|---|---|---|---|
| 4,171,190 | A | 10/1979 | Hudson | 417/350 |
| 4,385,025 | A | 5/1983 | Salerno et al. | 264/255 |
| 4,568,243 | A | 2/1986 | Schubert et al. | 415/213 |
| 7,189,053 | B2 | 3/2007 | Winkler et al. | 415/108 |
| 2005/0106046 | A1 * | 5/2005 | Winkler | 417/423.3 |

FOREIGN PATENT DOCUMENTS

| | | | |
|---|---|---|---|
| DE | 32 27 017 | A | 4/1983 |
| DE | 38 23 477 | A | 1/1990 |
| DE | 39 27 426 | A | 2/1991 |
| DE | 10 2004 033 215 | A | 2/2005 |
| EP | 1 498 613 | | 1/2005 |

* cited by examiner

*Primary Examiner* — Anh Mai
*Assistant Examiner* — Brenitra M Lee
(74) *Attorney, Agent, or Firm* — Milton Oliver, Esq.; Oliver Intellectual Property LLC

(57) ABSTRACT

A miniature fan arrangement has a fan (10) including an electronically commutated drive motor (21), a first circuit board (52) associated with said motor, and a fan housing (30). The fan also has a mounting part arranged radially outside the fan housing (30), and has a membrane (32), made of an elastic material, that elastically connects the fan housing (30) and the mounting part (34) to one another. A second circuit board (54) is arranged between the mounting part (34) and the fan housing (30) and is electrically connected to the first circuit board (52). The structure provides space for additional motor control components, particularly in small-sized motors.

25 Claims, 13 Drawing Sheets

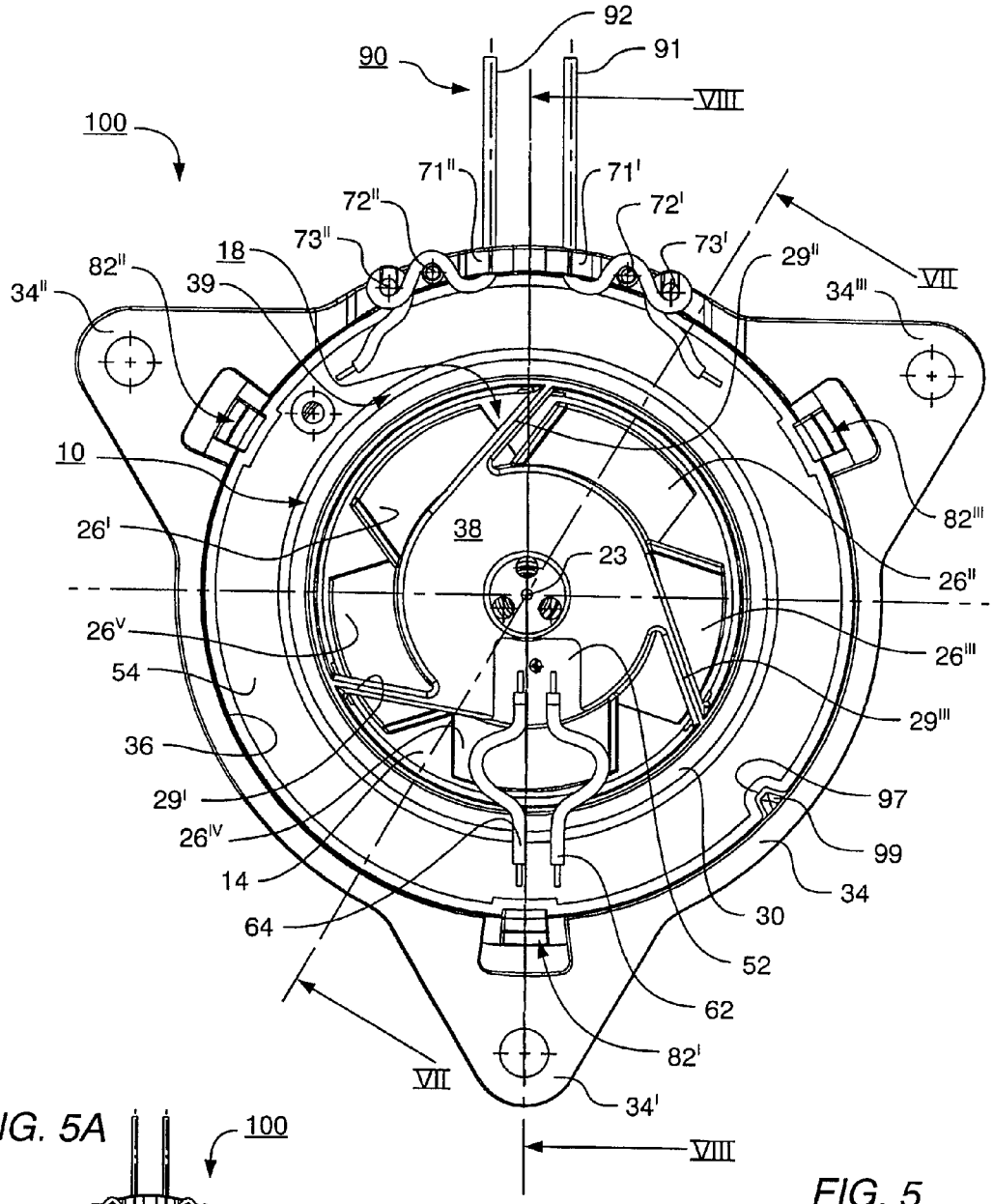
FIG. 5
FIG. 5A
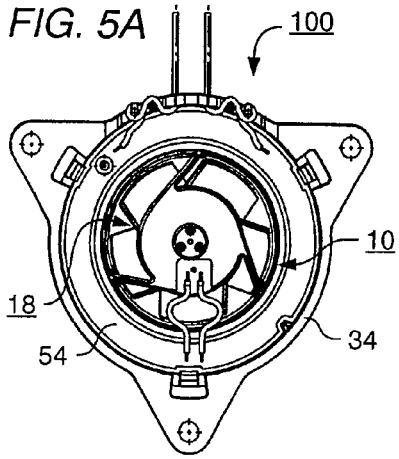

FAN ARRANGEMENT

CROSS-REFERENCE

This application claims priority from our German application 20 2008005 917.8, filed 21 Apr. 2008, the entire content of which is incorporated by reference. The application refers to commonly-assigned U.S. Ser. No. 10/884,697, now U.S. Pat. No. 7,189,053, WINKLER & METZGER.

FIELD OF THE INVENTION

The present invention relates to a miniature fan arrangement and, in particular, to a miniature fan arrangement having a vibration-damping suspension system.

BACKGROUND

EP 1 498 613 A2 and U.S. Pat. No. 7,189,053, WINKLER & METZGER (commonly assigned with the present application) disclose an arrangement in which, in order to reduce vibrations generated by a fan, the fan is suspended in a mounting frame using a flexible part. This is advantageous in particular when the vibrations generated by the fan can be perceived as irritating, for example when a vehicle seat or items of equipment are being ventilated.

In numerous applications, miniature or subminiature fans having housing dimensions of 20 to 60 mm on a side are used to create such fan arrangements. These fans must often be equipped, in an application-specific manner, with an expanded electronic control and protection system that is necessary for cooling purposes or, in combination with a small heating system, for heating purposes, for example in automobiles, trains, aircraft, control cabinets, switching cabinets, and IT electronics cabinets. In addition, this electronic system can also be designed to operate the fan alternatively for blowing or for suction. Because of the very small dimensions of miniature and subminiature fans, however, the expanded electronic control and protection system usually cannot be arranged, or can be arranged only partly, on the circuit board associated with the fan.

SUMMARY OF THE INVENTION

It is therefore an object of the present invention to make available a novel miniature fan arrangement with enough space for more components.

This object is achieved by a miniature fan arrangement having a first circuit board, a fan housing, a mounting part arranged radially outside the fan housing, a membrane which elastically connects the fan housing and the mounting part to each other, and a second circuit board, electrically connected to the first circuit board, arranged in a region between the mounting part and the fan housing.

An additional component placement surface is made available here by the use of a second circuit board that is arranged radially inside an outer mounting part and outside a fan housing of the fan. The dimensions of the second circuit board are preferably determined as a function of the dimensions of the fan housing and of the mounting part, so that their dimensions can continue to remain small.

This object can also be achieved by a miniature fan arrangement having a fan housing, an electronically commutated drive motor, a first circuit board arranged inside the fan housing, a second circuit board arranged outside the fan housing and electrically connected to the first circuit board, a mounting part arranged outside the fan housing, and a membrane elastically connecting the fan housing and the mounting part to each other. Here the additional component placement surface is made available by the use of a second circuit board that is arranged radially inside the fan housing.

It is thereby possible, even in the case of miniature and subminiature fans having a very small physical size, to implement an expanded electronic control system in simple fashion with no impairment of air output and air pressure buildup or of the fan's output. This electronic control system can comprise protection against incorrectly polarized connection, overvoltage protection, and/or stall protection. In addition, the fact that the additional component placement surface is made available creates room for a control system using pulse width modulation (PWM), for an analog and/or output-based control system, and for LAN-(Local Area Network) or CAN-(Controller Area Network) bus control systems.

BRIEF FIGURE DESCRIPTION

Further details and advantageous refinements of the invention are evident from the exemplifying embodiments, in no way to be understood as a limitation of the invention, that are described below and depicted in the drawings, in which:

FIG. 5 is a plan view of the discharge side of the fan arrangement of FIG. 1;

FIG. 5A is a depiction of FIG. 5 at actual size, i.e. at 1:1 scale;

FIG. 1 is a sectioned view of the fan arrangement of FIG. 1, looking in the direction of line VII-VII of FIG. 5;

DETAILED DESCRIPTION

Figure 1:
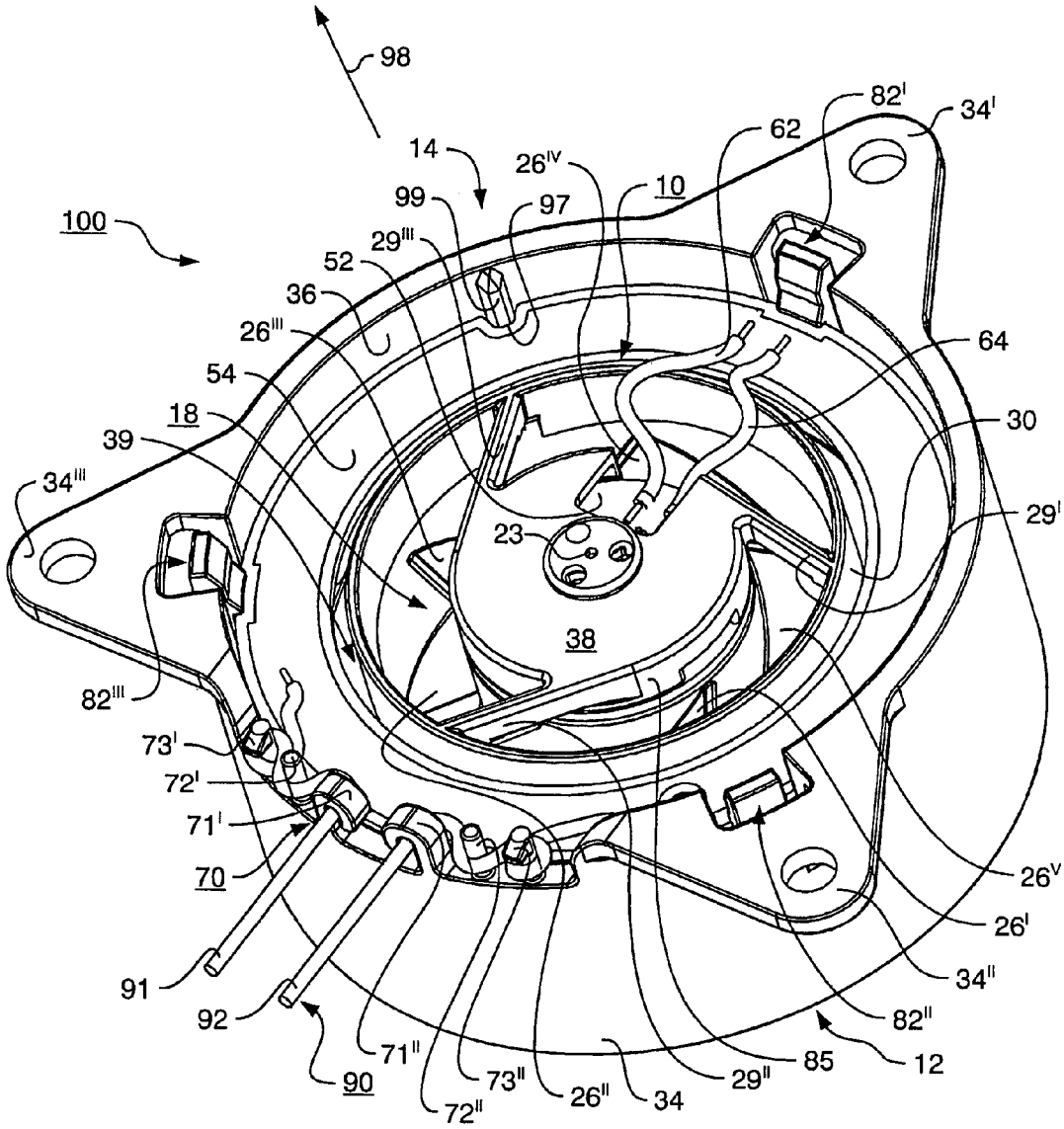
FIG. 1 is a perspective view of the discharge side of a fan arrangement in accordance with a first embodiment.

In the description that follows, the terms "left," "right," "front," "rear," "upper," and "lower" refer to the particular figure of the drawings, and can vary from one figure to the next as a function of a particular orientation (portrait or landscape) that is selected. Identical or identically functioning parts are labeled with the same reference characters in the various figures, and usually are described only once.

FIG. 1 shows a first embodiment of a fan arrangement 100 having a fan 10 and a mounting part 34. Mounting part 34 has mounting flanges 34', 34", 34'" for mounting the fan arrangement 100, which arrangement can be bolted, riveted, adhesively bonded, or welded via mounting flanges 34' 34", 34'". Alternatively, mounting part 34 can itself be directly foam-embedded into wall foams, foam cushions, foam seat backs, etc.

Fan 10 has a fan housing 30 in which a fan wheel 18 is arranged rotatably about a rotation axis 23 (FIG. 7) that extends along the longitudinal axis of fan housing 30. When fan 10 is in operation, fan wheel 18 delivers air in the direction of an arrow 98 (FIGS. 1, 7) from a suction side 12 to a discharge side 14 of fan 10, and has fan blades 26' to 26" whose shape is adapted to the shape of the inner side of fan housing 30.

Figure 2:
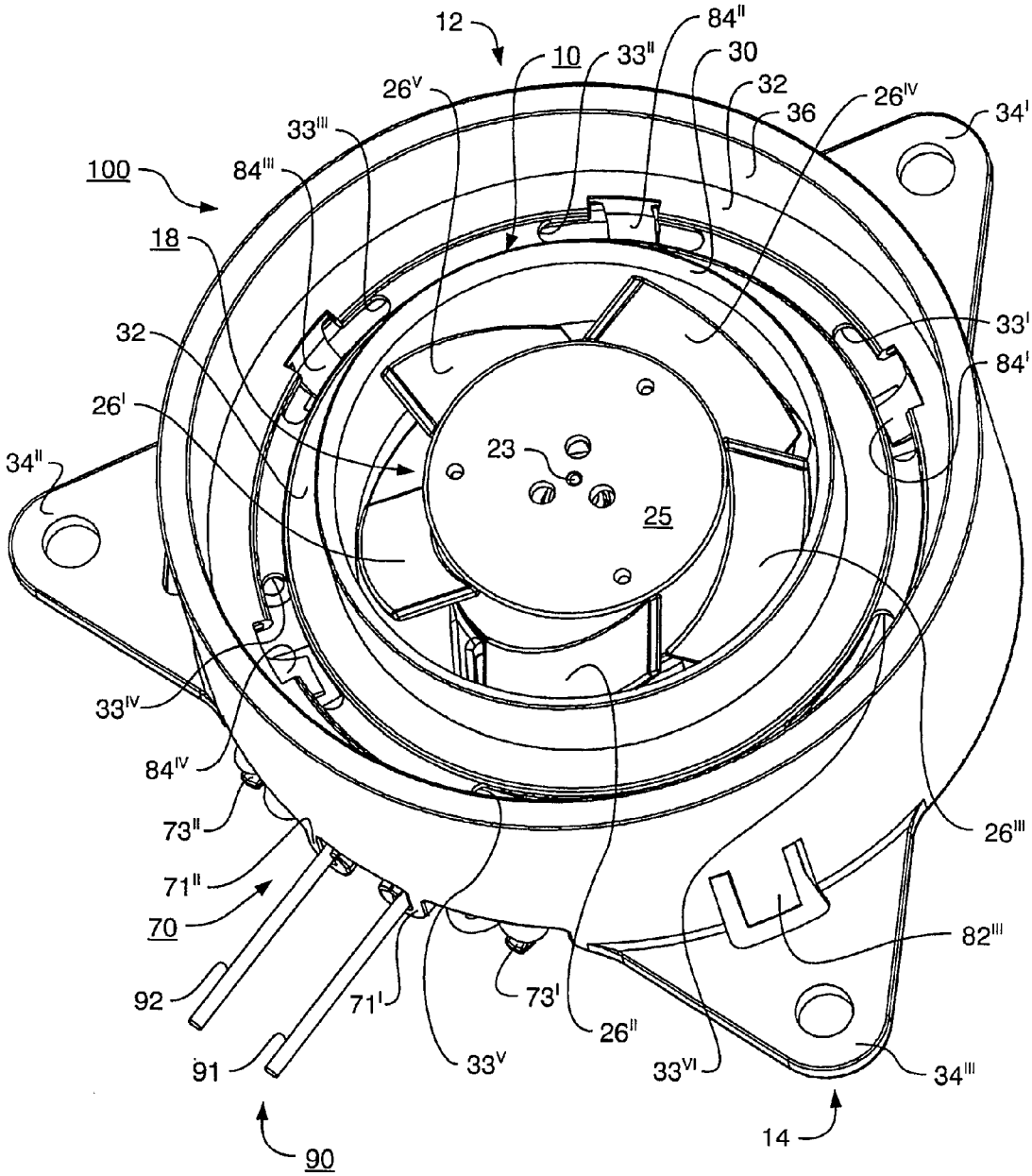
FIG. 2 is a perspective view of the suction side of the fan arrangement of FIG. 1.

As described in FIG. 2, fan housing 30 is suspended via a vibration-damping suspension system 32 (FIGS. 2, 7, 8) in mounting part 34, which is arranged radially outside fan housing 30. Suspension system 32 serves to reduce vibrations and noise emissions that occur during the operation of fan 10.

Fan 10 has a motor 21 (FIGS. 7 to 9) to drive its fan wheel 18, which motor 21 is preferably implemented as an electronically commutated external-rotor motor. It has a rotor cup 25 (FIGS. 2, 7, 8) on which fan wheel 18 is mounted. A mounting flange 38, which is provided on a motor retaining tray 85 and is joined via struts 29' to 29'" to fan housing 30, serves for the installation of motor 21 in fan housing 30.

Motor 21 has associated with it a first circuit board 52 for the reception of components of the motor electronics, which first circuit board 52 is arranged inside fan housing 30. Said board is connected via flexible connector leads 62, 64 (FIG. 1) to a second circuit board 54 that is provided as an additional component placement surface for an expanded electronic control and protection system.

According to a first embodiment, second circuit board 54 is arranged radially inside mounting part 34 and radially outside fan housing 30. The dimensions of second circuit board 54 are preferably determined as a function of the dimensions of fan housing 30 and of mounting part 34.

In FIG. 1 fan housing 30 is implemented, by way of example, in a tubular shape and second circuit board 54 is arranged annularly around the tubular fan housing 30. Second circuit board 54 can be provided, in this context, either in the region of suction side 12 or in the region of discharge side 14 of fan 10.

Be it noted that the use of a single second circuit board 54 that is arranged m the region of suction side 12 or discharge side 14 of fan 10 serves merely as an example for illustration of an exemplifying embodiment of the invention. Various modifications and variants are possible without changing the manner of operation of fan arrangement 100 according to the present invention. For example, second circuit board 54 can be provided on suction side 12 of fan 10, and a third circuit board is arranged in the region of the latter's discharge side 14, the second and third circuit board being, for example, interconnected in electrically conductive fashion.

Provided between second circuit board 54 and fan housing 30 is at least one cutout 39 that, when discharge side 14 of fan 10 is closed off, enables a return flow (from discharge side 14 to suction side 12) of air delivered by fan wheel 18. Cutout 39 is implemented in FIG. 1 as an annular gap between second circuit board 54 and fan housing 30.

Provided in FIG. 1 for the mounting of second circuit board 54 in mounting part 34 are, by way of example, three mounting elements 82', 82", 82'" that are implemented, for example, as radially resilient latching tongues on inner side 36 of mounting part 34. Upon installation of second circuit board 54, these are inserted from discharge side 14 (in FIG. 1) into mounting part 34, latching tongues 82', 82", 82'" first being bent radially outward from a predefined starting position so as then, after the insertion of second circuit board 54, to spring back into their starting position and latch-mount circuit board 54. In order to ensure correct assembly of second circuit board 54, the latter preferably has a guide groove 97 that, upon insertion into mounting part 34, is guided along a guide projection 99 provided on inner side 36 of mounting part 34.

After assembly, second circuit board 54 can be connected via leads 62, 64 to first circuit board 52, for example by soldering. For delivery of an operating voltage for motor 21, second circuit board 54 is furthermore electrically connected, e.g. once again by soldering, to a flexible voltage supply lead 90 that comprises two leads 91, 92. In many cases additional leads are provided, for example for a tacho signal or an alarm signal.

According to an embodiment of the invention, a strain relief apparatus 70 for flexible voltage supply lead 90 is provided on mounting part 34. Said apparatus has at least one securing hook-formed post 71', 71", at least one winding post 72', 72", and at least one hooking post 73', 73". Securing hook-formed post 71', 71" serves to secure lead 90, which is then guided from there, around winding post 72', 72", to hooking post 73', 73". At hooking post 73', 73", lead 90 is wound at least once around the post's entire outer periphery and then guided to circuit board 54 (see FIGS. 1 and 3). The hook of hooking post 73', 73" prevents lead 90 from slipping out. Because of the friction occurring between securing hook-formed post 71', 71", winding post 72', 72", hooking post 73', 73", and lead 90 in the context of tensile force on lead 90, lead 90 is held securely in strain relief apparatus 70 so that its electrical connection to second circuit board 54 is protected from damage or destruction due to tensile force.

As is evident from FIG. 1, a separate strain relief apparatus can be provided for each lead 91, 92 of voltage supply lead 90. Correspondingly, a securing hook-formed post 71', a winding post 72', and a hooking post 73' for lead 91, and a securing hook-formed post 71", a winding post 72", and a hooking post 73" for lead 92, are provided in FIG. 1.

FIG. 2 shows suction side 12 of fan arrangement 100 of FIG. 1. FIG. 2 illustrates latching tongue 62'" provided on mounting part 34, as well as vibration-damping suspension system 32. FIG. 2 further shows bracing elements 84', 84", 84'", $84^{IV}$ for bracing second Circuit board 54 (FIG. 1).

According to an embodiment, vibration-damping suspension system 32 is a membrane or diaphragm, made of an elastic material, that elastically joins fan housing 30 and mounting part 34 to one another. Membrane 32 is made, for example, of a plastic or an elastomer and implemented as a direct connection between mounting part 34 and fan housing 30. Membrane 32 can be joined in positive and/or materially connected fashion to fan housing 30 and/or to mounting part 34. Membrane 32 is joined almost entirely or completely to fan housing 30 over the latter's entire outer periphery. The membrane is joined almost entirely or completely to mounting part 34 on its entire inner side 36.

As shown in FIG. 2, membrane 32 has six openings 33', 33", 33'", $33^{IV}$, $33^{V}$, $33^{VI}$. These serve, in the event of a closure of discharge side 14 of fan 10, to enable a return flow (from discharge side 14 to suction side 12) of air delivered by fan wheel 18.

A suitable membrane for suspension of a fan housing in a mounting part is described in EP 1 498 613 A2 and corresponding U.S. Pat. No. 7,189,053, WINKLER & METZGER, to which reference is expressly made here. A more detailed description of membrane 32 is therefore omitted.

Bracing elements 84', 84", 84'", $84^{IV}$ are implemented, according to an embodiment, as axially resilient support members on inner side 36 of mounting port 34. Circuit board 54, is supported resiliently on them after being installed in mounting part 34, as described below with reference to FIG. 7.

Figure 3:
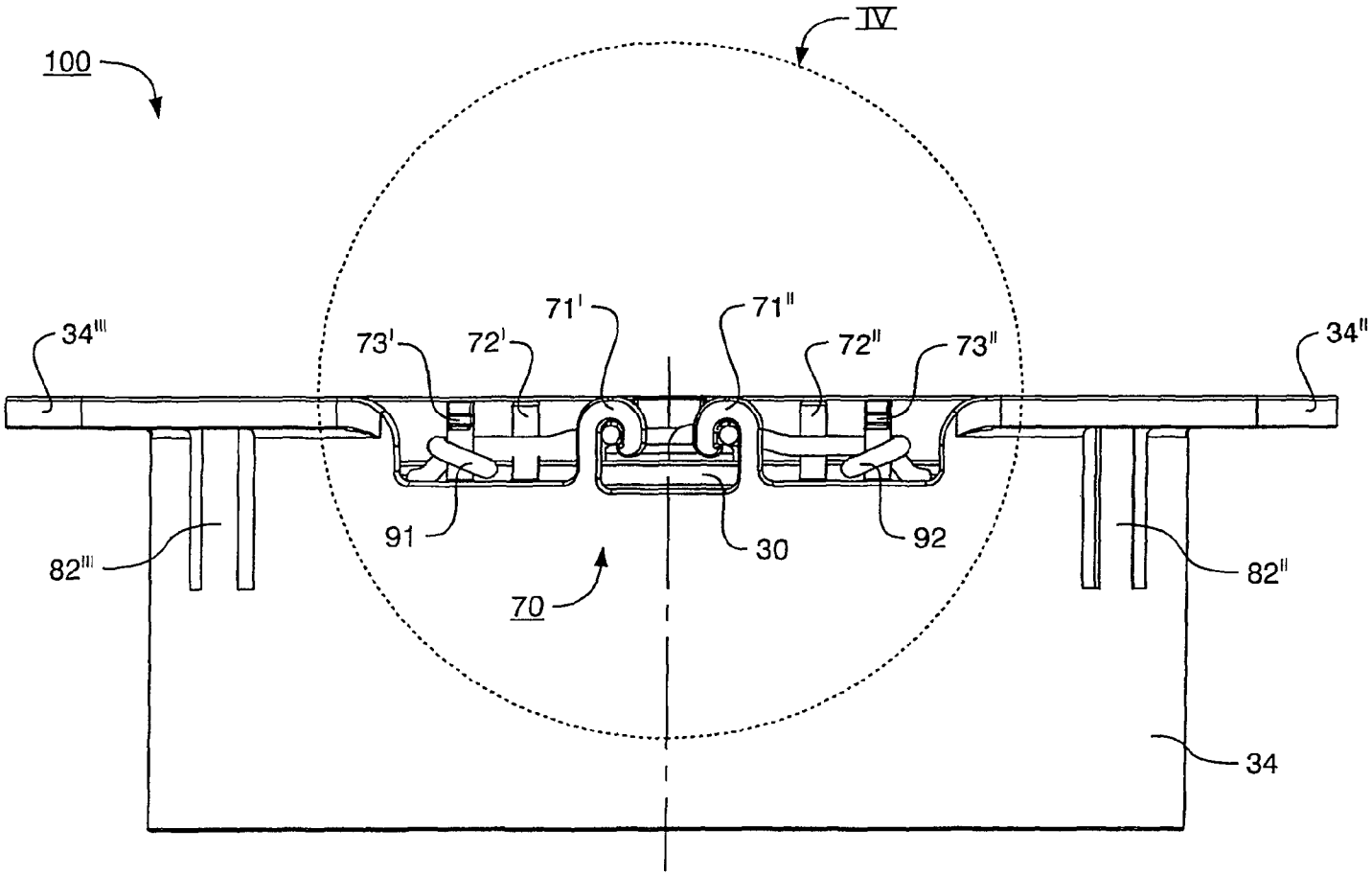
FIG. 3 is a side view of the fan arrangement of FIG. 1.

FIG. 3 is a side view of fan arrangement 100 of FIG. 1 with strain relief apparatus 70 and resilient latching tongues 82", 82'" provided on mounting part 34.

Figure 4:
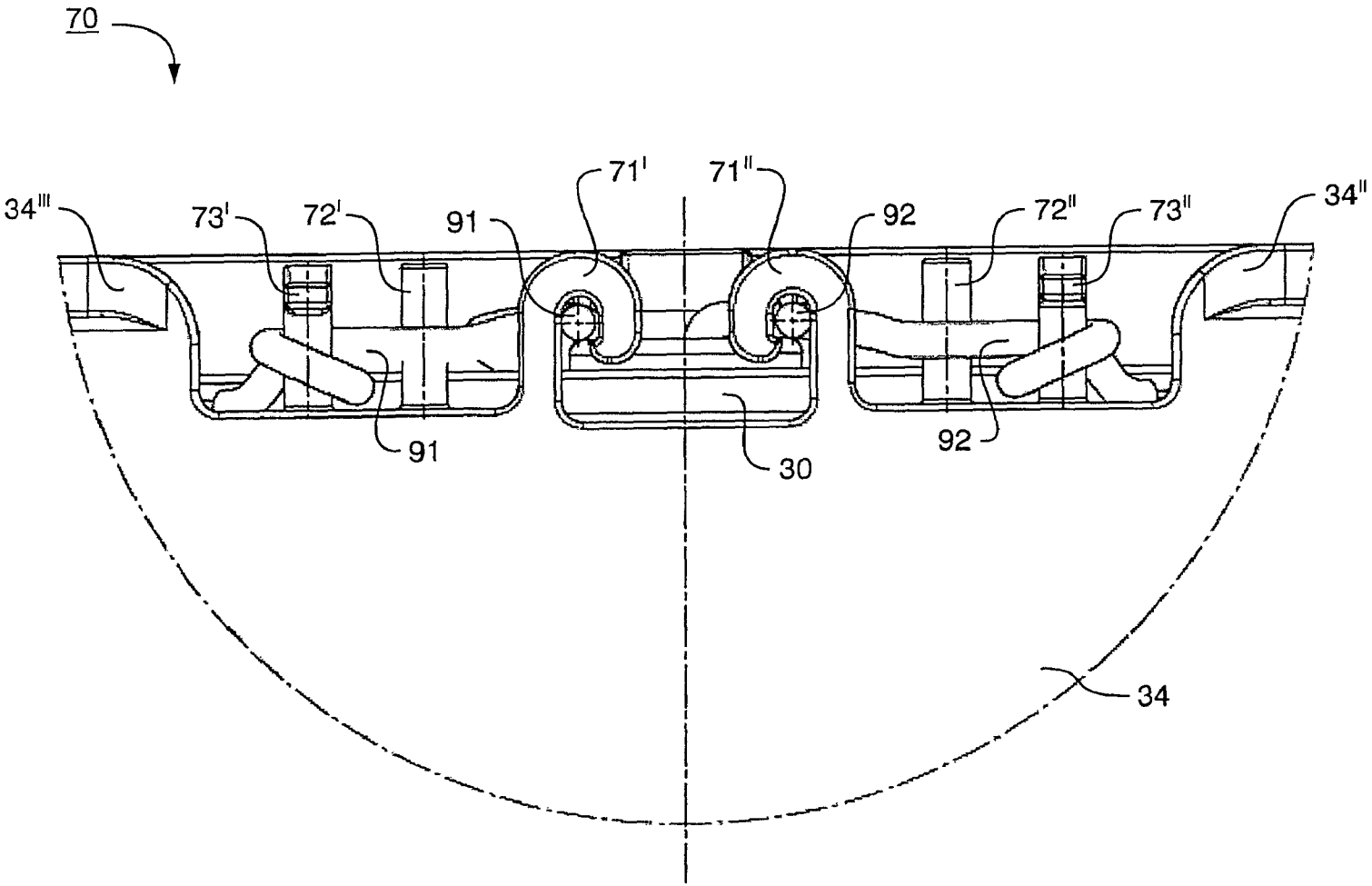
FIG. 4 is an enlarged side view of the strain relief apparatus of FIG. 3.

FIG. 4 is a greatly enlarged view (5:1 scale) of strain relief apparatus 70 of FIG. 3. FIG. 4 illustrates leads 91 and 92 that are respectively secured in securing hook-formed posts 71', 71", guided around winding posts 72', 72", and wound at least once around the entire outer periphery of hooking posts 73', 73".

FIG. 5 is a plan view of discharge side 14 of fan arrangement 100 of FIG. 1. FIG. 5 illustrates the latch-mounting of second circuit board 54, having the radially resilient latching tongues 82', 82", 82'", in mounting part 34.

FIG. 5A shows FIG. 5 at actual size, i.e. at 1:1 scale.

Figure 6:
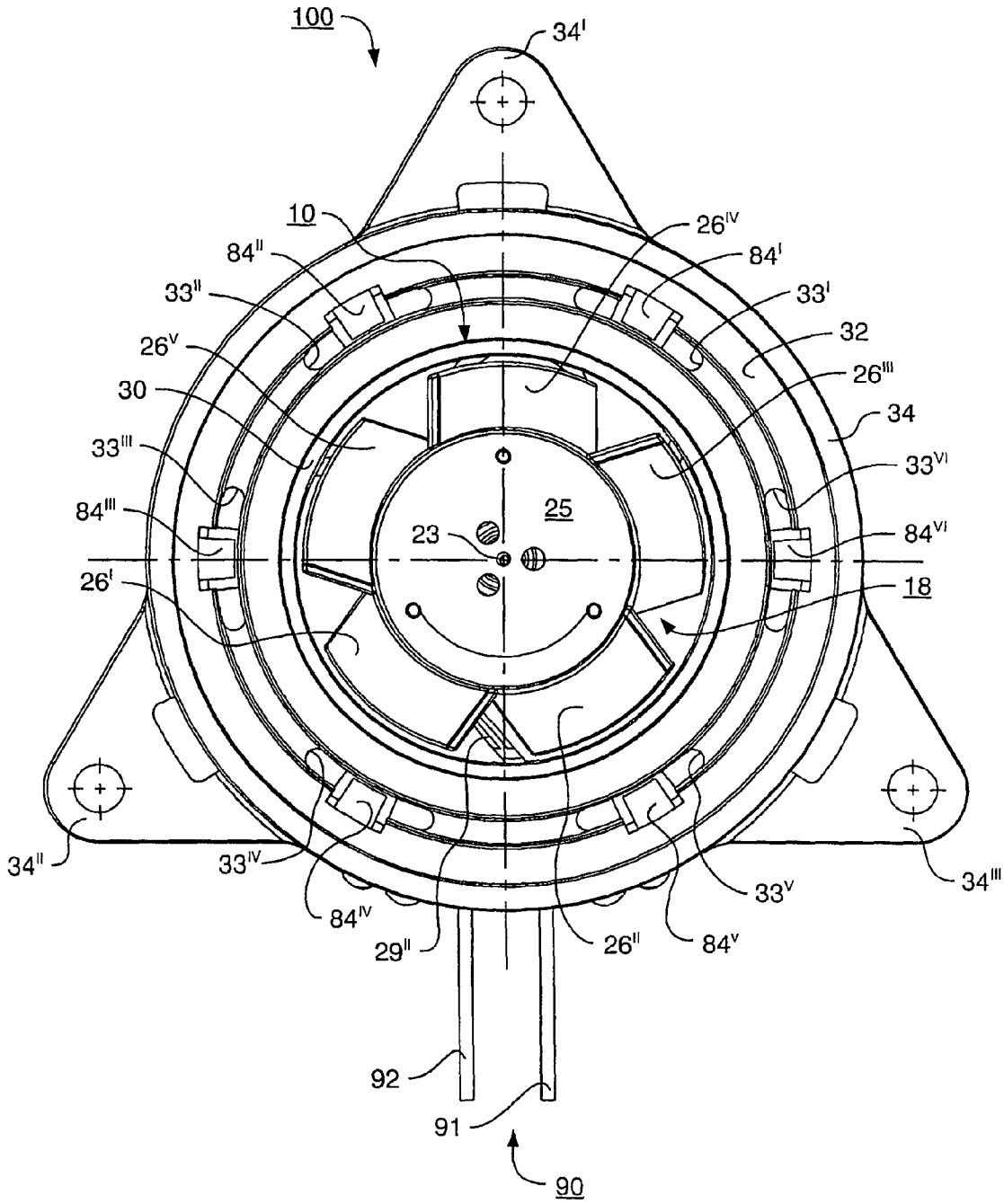
FIG. 6 is a plan view of the suction side of the fan arrangement of FIG. 1.

FIG. 6 is a plan view of suction side 12 of fan arrangement 100 of FIG. 1. Membrane 32 is, by way of example, joined positively to fan housing 30 and to mounting part 34. FIG. illustrates the six openings 33', 33", 33'", $33^{IV}$, $33^{V}$, $33^{VI}$ provided in membrane 32, and the resilient support members 84', 84", 84'", $84^{IV}$, $84^{V}$, $84^{VI}$.

Figure 7:
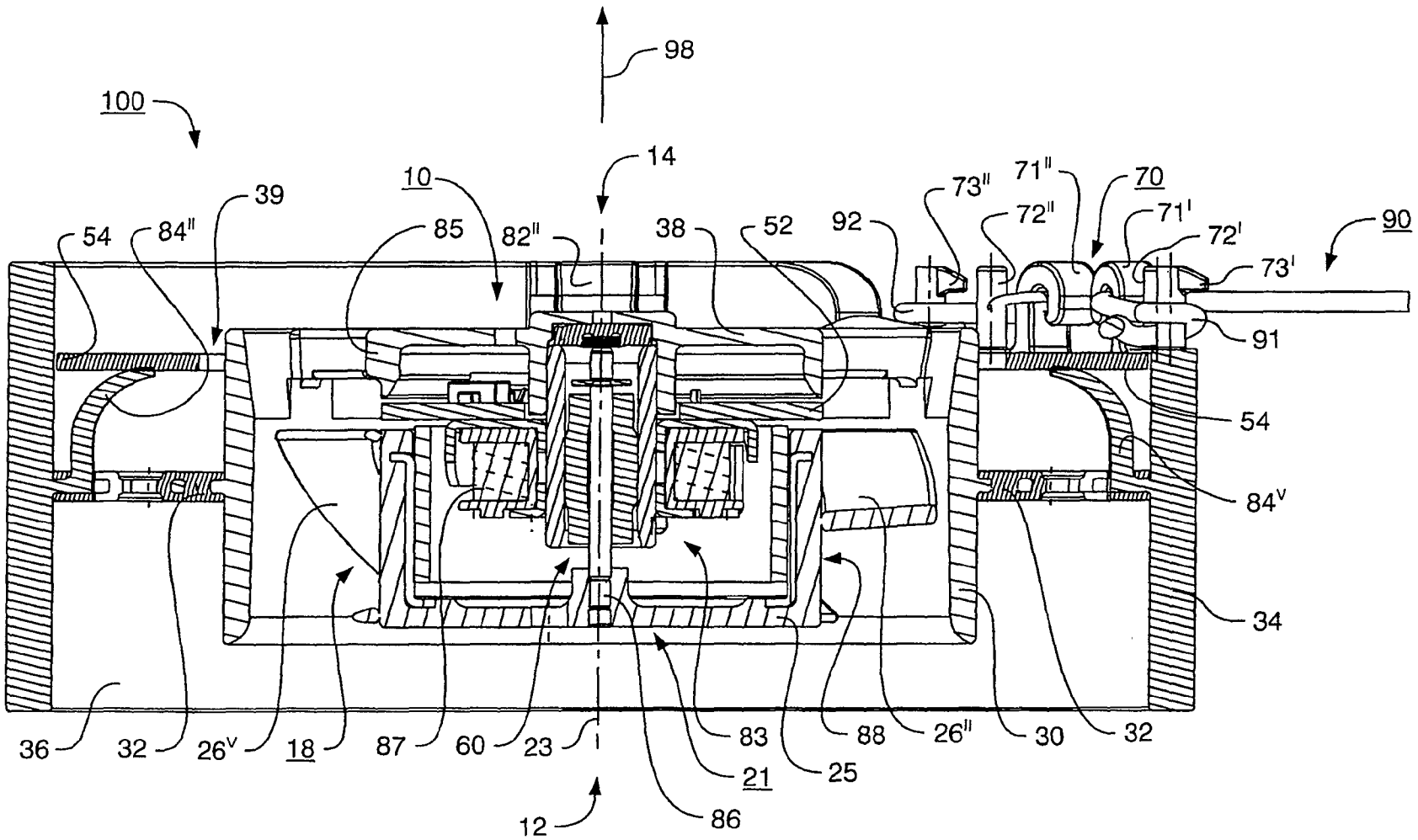

FIG. 7 is a sectioned view of fan arrangement 100 of FIG. 1, and illustrates membrane 32 joined in positive and materially connected fashion to fan housing 30 and to mounting part 34, as well as the resilient support members 84", $84^{v}$ provided on mounting part 34, on which members second circuit board 54 is supported.

The electronically commutated drive motor 21 has a stator arrangement 83 having claw pole laminations 87, an external rotor 88, and a motor retaining tray 85 equipped with mounting flange 38. Rotor 88 comprises rotor cup 25 on which fan wheel 18 is mounted, as well as a rotor shaft 96 that is journaled in a bearing arrangement 60 rotatably about rotation axis 23.

Figure 8:
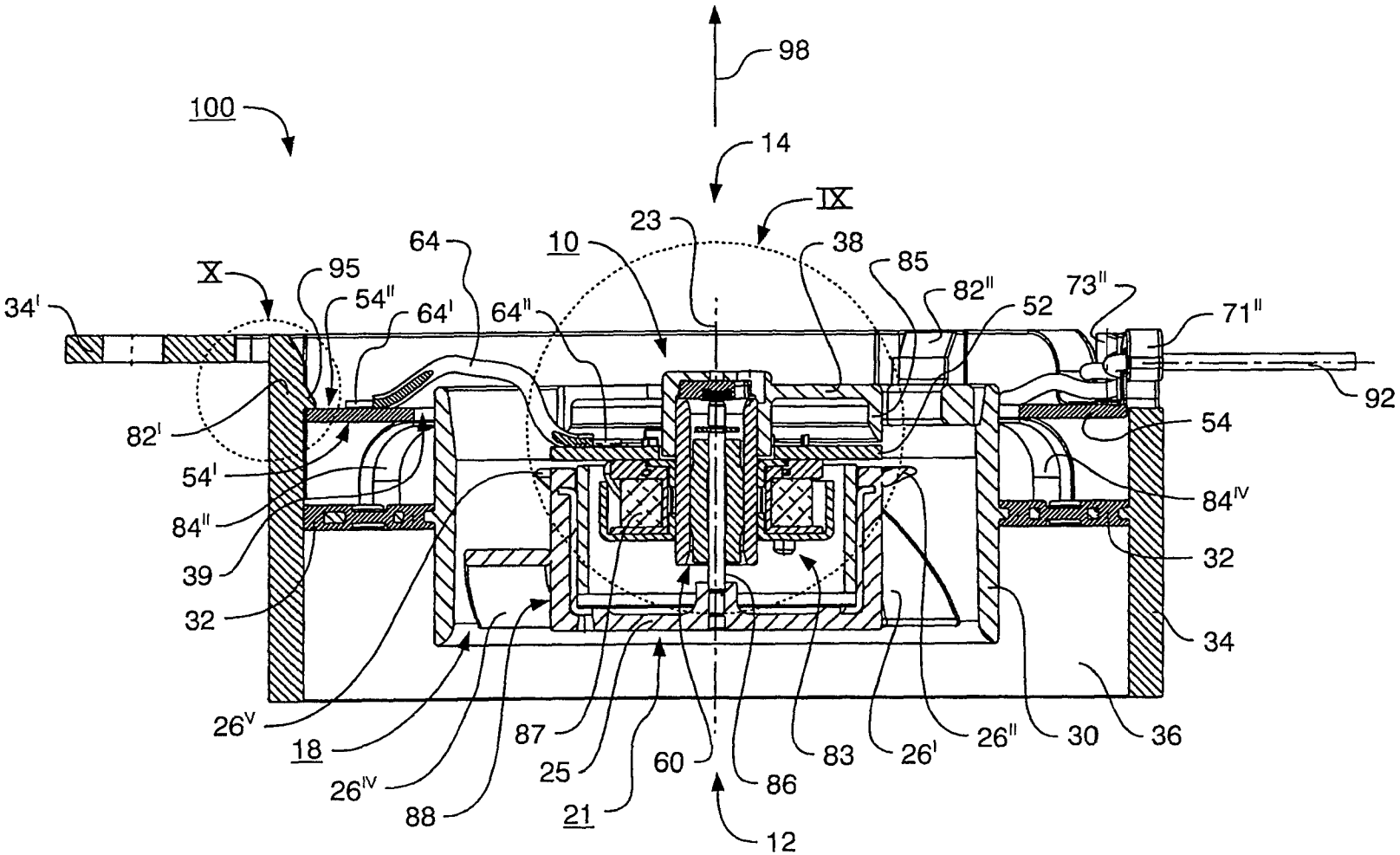
FIG. 8 is a sectioned view of the fan arrangement of FIG. 1, looking in the direction of line VIII-VIII of FIG. 5.

FIG. 8 is a sectioned view of fan arrangement 100 of FIG. 1. FIG. 8 illustrates the mounting of second circuit board 54 in mounting part 34, and the connection of electrical connector lead 64 to first and second circuit boards 52 and 54, respectively.

Second circuit board 54 is supported with its lower side 54' on resilient support members 84", $84^{IV}$, and is latch-mounted on its upper side 54". Latching tongue 82' has for this purpose a latching hook 95 that latches in on upper side 54" of circuit board 54.

Provided on this upper side 54" is an electrical terminal 64' on which is mounted one end of connector lead 64, the other end of which is connected to an electrical terminal 64" provided on first circuit board 52. The length of connector lead 64 is selected in consideration of the resilient travel of membrane 32, in order to prevent damage to or destruction of the electrical connection between circuit boards 52, 54 during the operation of fan 10, for example due to detachment of lead 64.

Figure 9:
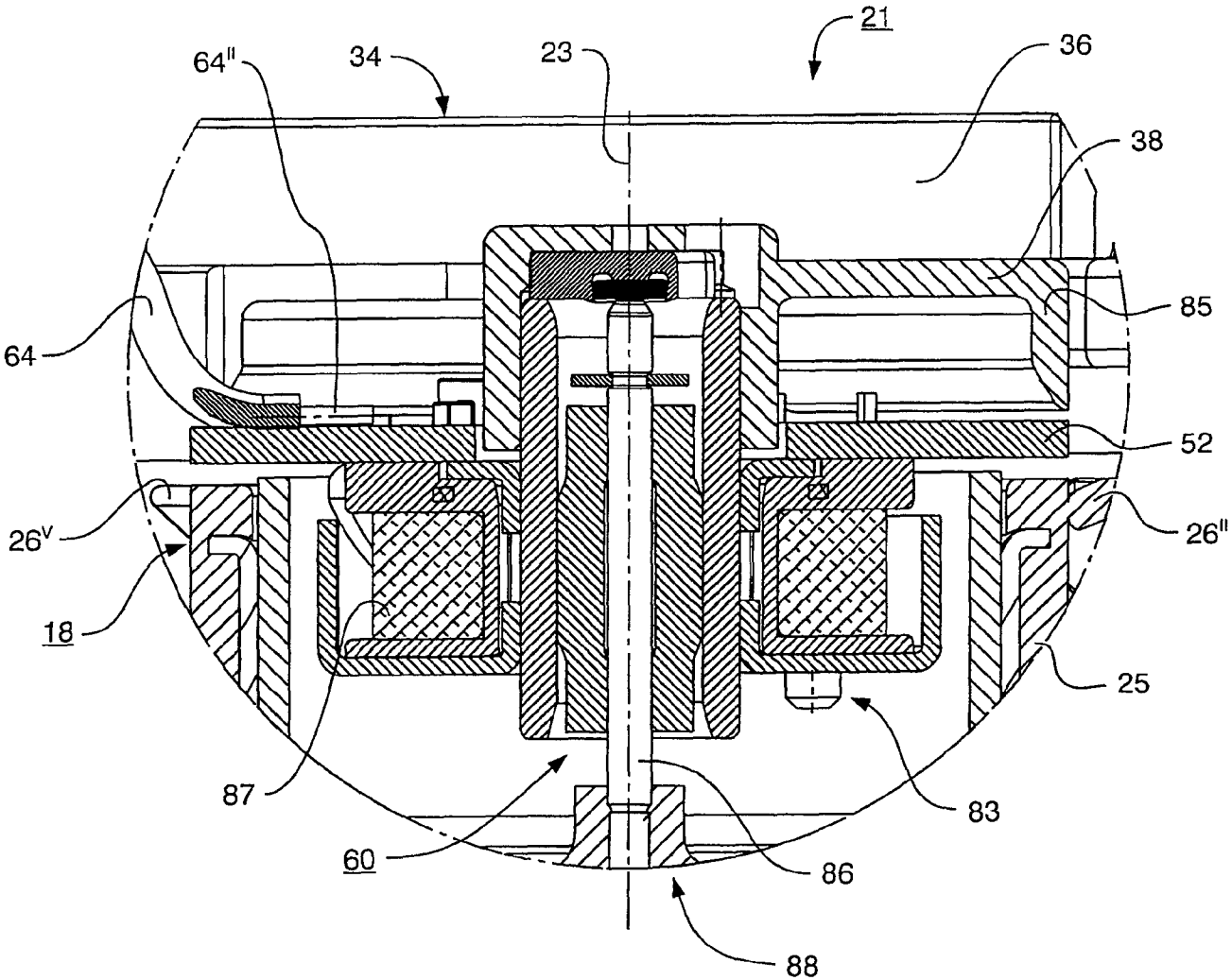
FIG. 9 is an enlarged view of detail IX of FIG. 8.

FIG. 9 is a greatly enlarged view of drive motor 21 of FIG. 8, and shows lead 64 connected to electrical terminal 64" that is provided on first circuit board 52.

Figure 10:
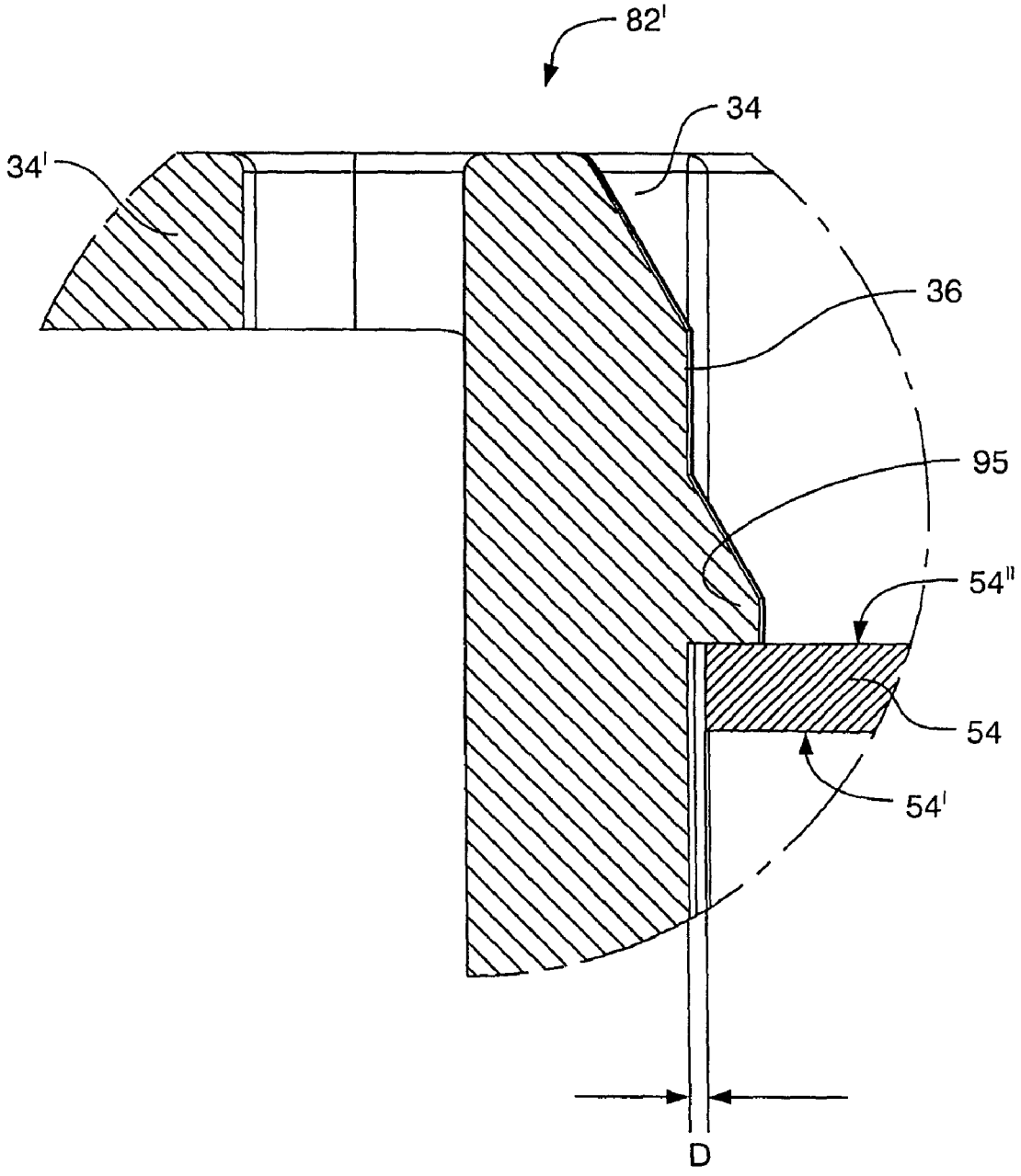
FIG. 10 is an enlarged view of detail X of FIG. 8.

FIG. 10 is a greatly enlarged view of the resilient latching tongue 82' of FIG. 8 which, with its latching hook 95 latched in on upper side 54" of circuit board 54, latch-mounts circuit board 54 in mounting part 34. There exists between circuit board 54 and inner side 36 of mounting part 34 a clearance D that compensates for possible movements of second circuit board 54 during the operation of fan 10 (FIG. 1).

Figure 11:
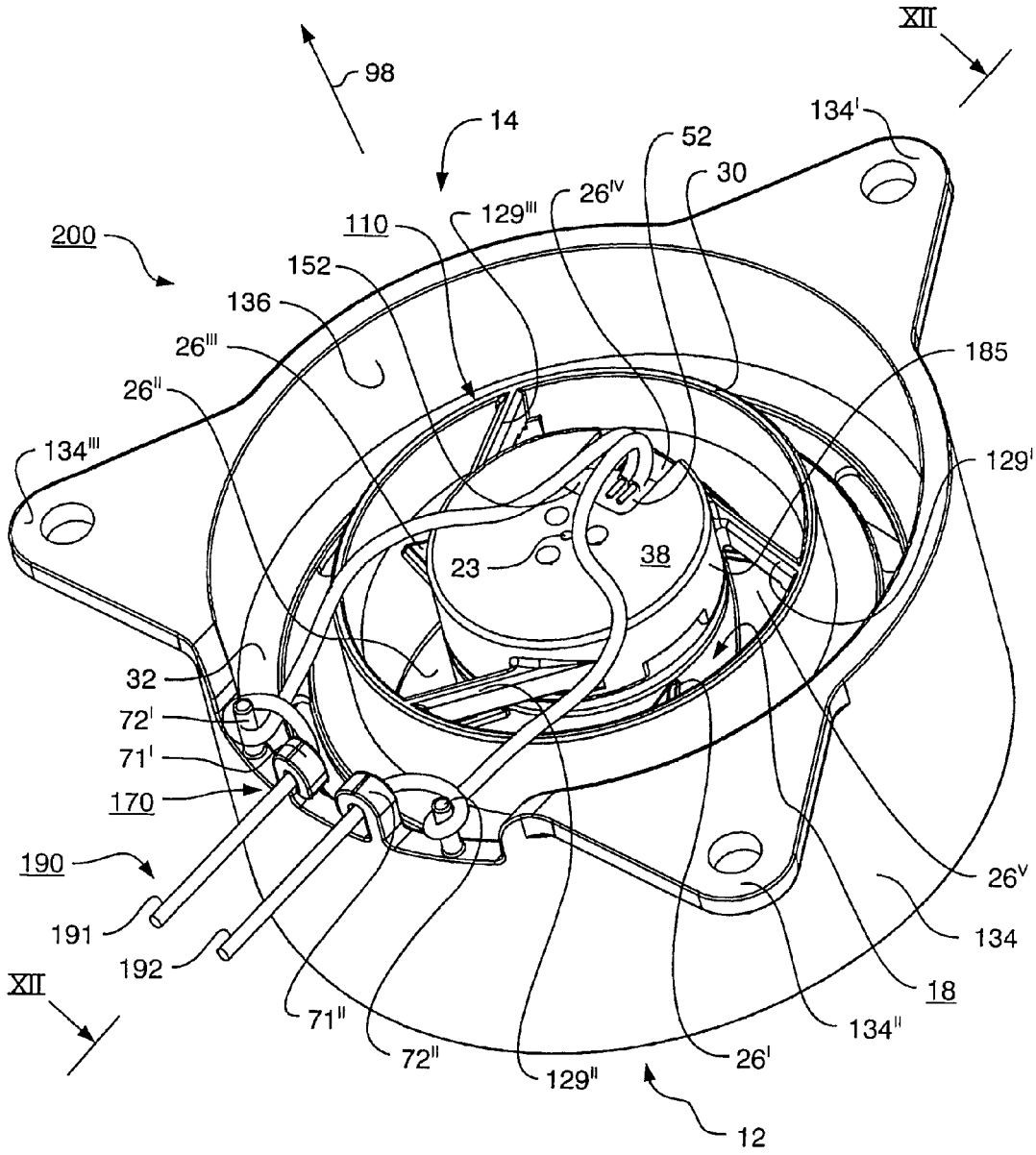
FIG. 11 is a perspective view of the discharge side of a fan arrangement in accordance with a second embodiment.

FIG. 11 shows a second embodiment of a fan arrangement 200 having a fan 110 and a mounting part 134, which latter comprises mounting flanges 134', 134", 134'" for mounting fan arrangement 200. Fan 110, like fan 10 of the first embodiment, has a fan housing 30 in which fan wheel 18 is arranged rotatably about rotation axis 23 (FIGS. 12, 13), which wheel, with its fan blades 26' to 26', delivers air in the direction of arrow 98 from suction side 12 to discharge side 14 of fan 110 during the operation of fan 10. Fan housing 30 is suspended in mounting part 34 via membrane 32.

Fan 110 has a motor 121 (FIGS. 12 and 13), preferably implemented as an electronically commutated external-rotor motor, to drive its fan wheel 18. Said motor has a rotor cup 25 (FIG. 12) on which fan wheel 16 is mounted. Mounting flange 38, which is provided on a motor retaining tray 185 and is joined via struts 129' to 129'" to fan housing 30, serves for installation of motor 121 in fan housing 30. Motor retaining tray 185 differs from motor retaining tray 85 of the first embodiment in a manner described below with reference to FIG. 12.

Associated with motor 121 is first circuit board 52, which is arranged inside fan housing 30. First circuit board 52 is connected in an electrically conductive manner, via a connector lead 148 (FIGS. 12 and 13), to a second circuit board 154 (FIGS. 12 and 13) that in this case is likewise arranged inside fan housing 30, as described below with reference to FIGS. 12 and 13.

For delivery of an operating voltage for motor 121, in FIG. 11 first circuit board 52 is connected in electrically conductive fashion, e.g. by soldering, via a flexible voltage supply lead 190 that comprises two leads 191, 192; further leads can be provided, e.g. for a tacho signal or an alarm signal. A strain relief apparatus 170 is provided for lead 190 on mounting part 134. This apparatus corresponds substantially to strain relief apparatus 70 of the first embodiment, except that hooking posts 73', 73" have been omitted.

Figure 12:
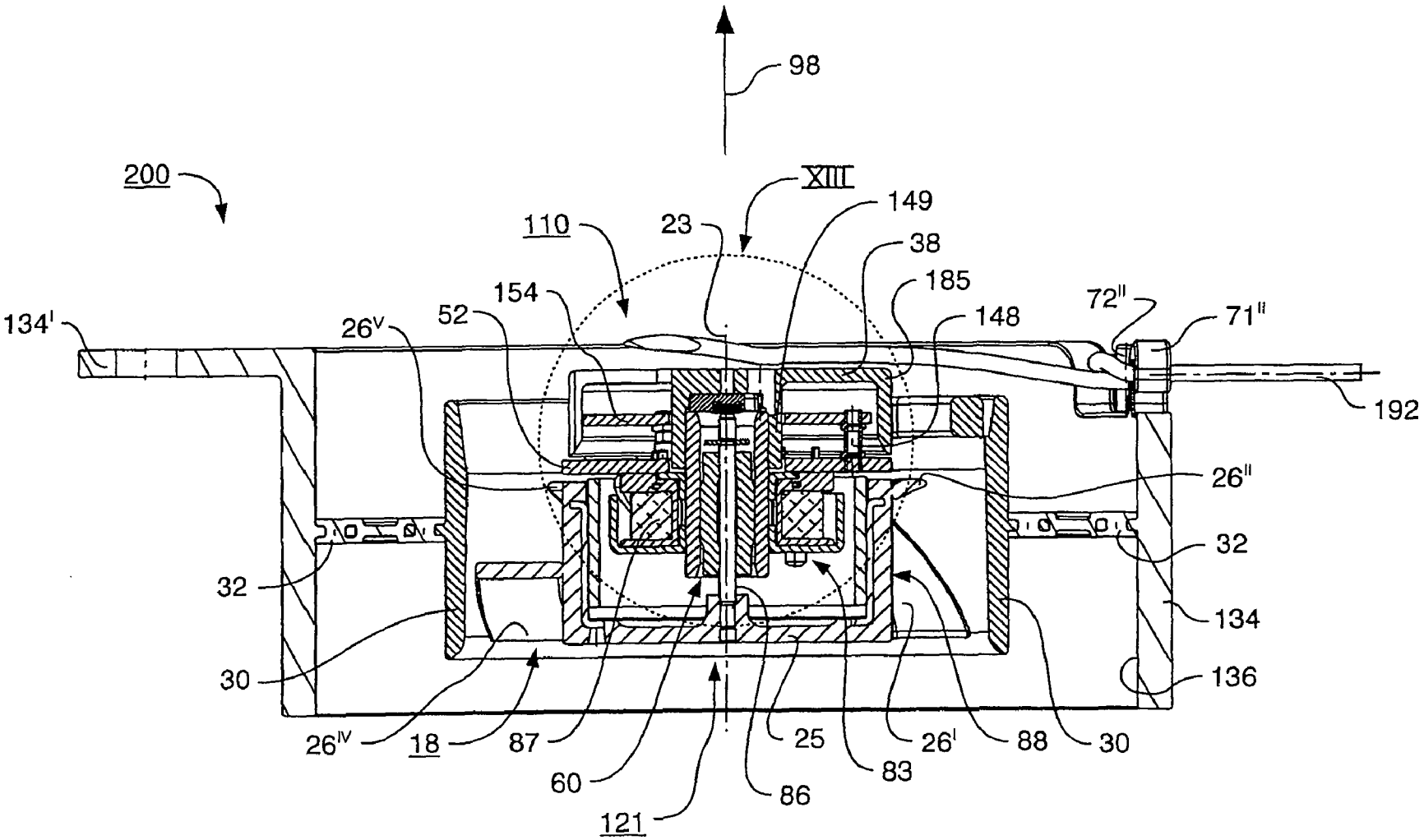
FIG. 12 is a sectioned view of the fan arrangement of FIG. 11, looking in the direction of line XII-XII of FIG. 11.

FIG. 12 is a sectioned view of fan arrangement 200 of FIG. 11, illustrating membrane 32 joined to fan housing 30 and to mounting part 134.

As is evident from FIG. 12, motor 121 corresponds substantially to drive motor 21, described above with reference to FIG. 7, having stator arrangement 83 and rotor 88. As compared with motor retaining tray 85 of the first embodiment, however, motor retaining tray 185 has a greater height and therefore a larger internal space, in which a second circuit board 154 is arranged. The latter is supported, in FIG. 12, on a bearing tube 149 of motor retaining tray 185. Second circuit board 154 is connected in an electrically conductive manner, via a connector lead 148, to first circuit board 52. Connector 148 is preferably a contact pin.

Figure 13:
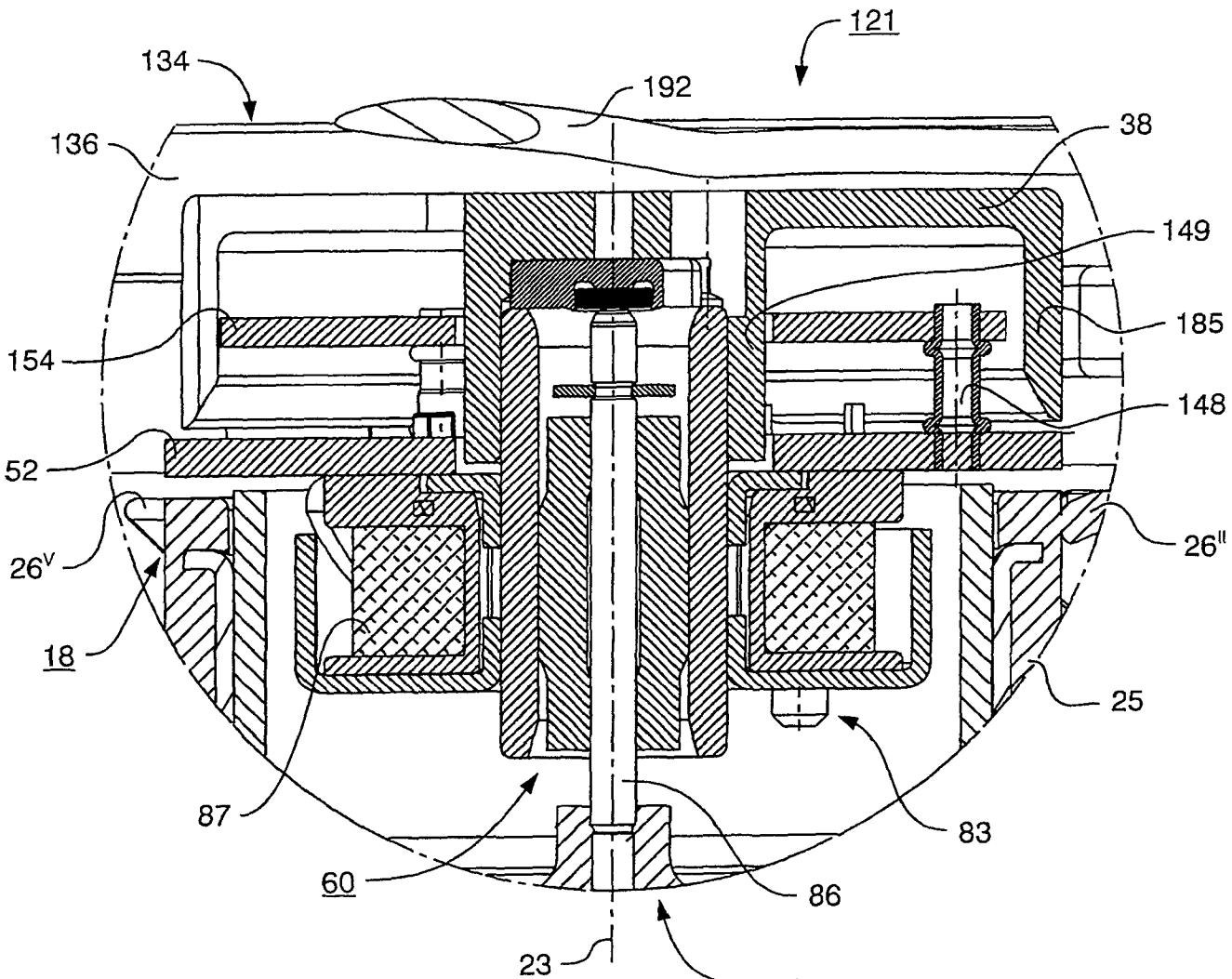
FIG. 13 is an enlarged view of detail XIII of FIG. 12.

FIG. 13 is a greatly enlarged view of drive motor 121 of FIG. 12, illustrating the electrically conductive connection between first and second circuit boards 52 and 154 via contact pin 148.

Numerous variants and modifications are of course possible, within the scope of the present invention.

What is claimed is:

1. A miniature fan arrangement comprising a fan (10) having:

an electronically commutated drive motor (21), a first circuit board (52) associated with said motor;

a fan housing (30);

a mounting part (34) arranged radially outside the fan housing (30);

a membrane (32), made of an elastic material, that elastically joins the fan housing (30) and the mounting part (34) to one another, such that the fan housing (30) is suspended in the mounting part (34) via the membrane (32);

a second circuit board (54) that is arranged in a region between the mounting part (34) and the fan housing (30) and is electrically connected to the first circuit board (52).

2. The miniature fan arrangement according to claim 1, wherein a fan wheel (18) is arranged inside the fan housing (30), said wheel, during operation, delivering air from a suction or intake side (12) of the fan (10) to a discharge side (14); and the second circuit board (54) is arranged adjacent the suction side (12).

3. The miniature fan arrangement according to claim 1, wherein a fan wheel (18) is arranged inside the fan housing (30), said wheel, during operation, delivering air from a suction side (12) of the fan (10) to a discharge side (14) thereof; and the second circuit board (54) being arranged adjacent a discharge or exhaust side (14) of said fan.

4. The miniature fan arrangement according to claim 1, wherein the fan housing (30) is implemented in tubular configuration; and the second circuit board (54) is arranged annularly around the tubular fan housing (30).

5. The miniature fan arrangement according to claim 1, wherein the mounting part (34) comprises at least one mounting element (82', 82", 82'") for mounting the second circuit board (54).

6. The miniature fan arrangement according to claim 5, wherein the at least one mounting element (82', 82", 82'") is implemented on the mounting part (34) as a radially resilient latching tongue on the mounting part (34).

7. The miniature fan arrangement according to claim 5, wherein the mounting part (34) comprises at least one bracing element (84', 84", 84'", $84^{IV}$, $84^{V}$, $84^{VI}$) for bracing the second circuit board (54); and the second circuit board (54) is arranged between the at least one mounting element (82', 82", 82'") and the at least one bracing element (84', 84", 84'", $84^{IV}$, $84^{V}$, $84^{VI}$).

8. The miniature fan arrangement according to claim 7, wherein the at least one bracing element (84', 84", 84'", $84^{IV}$, $84^{V}$, $84^{VI}$) is implemented on the inner side (36) of the mounting part (34) as an axially resilient support member on the inner side (36) of the mounting part (34).

9. The miniature fan arrangement according to claim 1, wherein the first and the second circuit board (52, 54) are electrically connected to one another via flexible leads (62, 64).

10. The miniature fan arrangement according to claim 1, wherein the second circuit board (54) is implemented as a component placement surface for an electronic control and/or protective system.

11. The miniature fan arrangement according to claim 1, wherein a fan wheel (18) is arranged inside the fan housing (30), said wheel, during operation, delivering air from a suction side (12) of the fan (10) to a discharge side (14) thereof; and the membrane (32) is formed with openings (33', 33", 33'", $33^{IV}$, $33^{V}$, $33^{VI}$) that, in the event of a closure of the discharge side (14), enable a reverse flow, from the discharge or exhaust side (14) of the fan to the suction or intake side (12), of air delivered by the fan wheel (18).

12. The miniature fan arrangement according to claim 11, wherein there is provided between the second circuit board (54) and the fan housing (30) at least one, opening (39) that, in the event of a closure of the discharge side (14), enables reverse flow, from the discharge side (14) to the suction side (12), of air delivered by the fan wheel (18).

13. The miniature fan arrangement according to claim 12, wherein the reverse-flow opening (39) is implemented as a gap between the second circuit board (54) and the fan housing (30).

14. The miniature fan arrangement according to claim 1, wherein the membrane (32) is made of a plastic material.

15. The miniature fan arrangement according to claim 1, wherein the membrane (32) is made of an elastomer.

16. The miniature fan arrangement according to claim 1, wherein the membrane (32) is implemented as a direct connection between the mounting part (34) and the fan housing (30).

17. The miniature fan arrangement according to claim 16, wherein the membrane (32) is joined to the fan housing (30) over substantially the entire outer periphery of the fan housing.

18. The miniature fan arrangement according to claim 16, wherein the membrane (32) is joined to the mounting part (34) over substantially the entire inner side (36) of said mounting part.

19. The miniature fan arrangement according to claim 16, wherein the membrane (32) is joined in materially connected fashion to at least one of the fan housing (30) and the mounting part (34).

20. The miniature fan arrangement according to claim 16, wherein the membrane (32) is joined positively to at least one of the fan housing (30) and the mounting part (34).

21. The miniature fan arrangement according to claim 1, wherein a flexible voltage supply lead (90) is connected to the second circuit board (54).

22. The miniature fan arrangement according to claim 21, wherein a strain relief apparatus (70) for the flexible voltage supply lead (90) is provided on the fan housing (30).

23. The miniature fan arrangement according to claim 22, wherein the strain relief apparatus (70) comprises at least one securing hook-formed post (71', 71") for securing the flexible voltage supply lead (90) onto the fan housing (30).

24. The miniature fan arrangement according to claim 22, wherein the strain relief apparatus (70) comprises at least one winding post (72', 72").

25. The miniature fan arrangement according to claim 22, wherein the strain relief apparatus (70) comprises at least one hooking post (73', 73").

* * * * *